US009343800B2

(12) United States Patent
Tran et al.

(10) Patent No.: US 9,343,800 B2
(45) Date of Patent: May 17, 2016

(54) FLEXIBLE MOUNTING APPARATUS FOR MOUNTING AN ANTENNA

(71) Applicant: MOTOROLA SOLUTIONS, INC., Schaumburg, IL (US)

(72) Inventors: Chi T Tran, Weston, FL (US); Parameswaran A. Sivalingam, Gelugor (MY); Boon Aik Eeo, Penang (MY); Kenney Koay, Simpang Ampat (MY); David H McClintock, Boynton Beach, FL (US)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 191 days.

(21) Appl. No.: 13/963,388

(22) Filed: Aug. 9, 2013

(65) Prior Publication Data

US 2015/0041614 A1 Feb. 12, 2015

(51) Int. Cl.

| | |
|---|---|
| ***H01Q 1/27*** | (2006.01) |
| ***H01Q 1/24*** | (2006.01) |
| ***H01Q 1/52*** | (2006.01) |

(52) U.S. Cl.

CPC ..... *H01Q 1/242* (2013.01); *H01Q 1/273* (2013.01); *H01Q 1/52* (2013.01)

(58) Field of Classification Search

CPC ..... H01Q 1/273; H01Q 1/085; H01Q 9/16; H02G 3/0475; H04B 1/385

USPC ..... 248/316.1, 316.7, 231.81, 228.7, 689

See application file for complete search history.

(56) References Cited

U.S. PATENT DOCUMENTS

| | | | | |
|---|---|---|---|---|
| 4,205,319 | A | 5/1980 | Gasparaitis et al. | |
| 5,524,327 | A * | 6/1996 | Mickel et al. | 24/115 A |
| 5,654,725 | A | 8/1997 | Kozlovski et al. | |
| 6,940,462 | B2 | 9/2005 | Packer | |
| D562,676 | S * | 2/2008 | Cox et al. | D8/395 |
| 7,969,369 | B2 * | 6/2011 | Wertman et al. | 343/718 |
| 2008/0238809 | A1 | 10/2008 | Mtchedlishvili et al. | |
| 2008/0252535 | A1 | 10/2008 | Parsche | |
| 2009/0295672 | A1 | 12/2009 | Grossman et al. | |
| 2012/0112981 | A1 | 5/2012 | Crowther et al. | |
| 2012/0293382 | A1 | 11/2012 | Matthews et al. | |

FOREIGN PATENT DOCUMENTS

WO 9807239 A1 2/1998

* cited by examiner

*Primary Examiner* — Rodney Mintz
*Assistant Examiner* — Daniel Kenny
(74) *Attorney, Agent, or Firm* — Barbara R. Doutre

(57) ABSTRACT

A mounting apparatus (102) comprises a plurality of flexible interconnected spacer segments (104) for receiving the antenna (106), the plurality of flexible interconnected spacer segments provide a continuous offset (114) between the antenna and another surface. Each of the plurality of flexible interconnected spacer segments (104) comprises a unitarily molded flexible link, each link having a triangular cross sectional geometry (350) having an opening (108) on top (302) for receiving the antenna, and the top leading to a wider base for mounting to a surface. The links are separable (312) providing for a customizable length and form factor.

24 Claims, 11 Drawing Sheets

FLEXIBLE MOUNTING APPARATUS FOR MOUNTING AN ANTENNA

TECHNICAL FIELD

The present application relates generally to a mounting apparatus for an antenna and more particularly to a mounting apparatus which facilitates concealment and offset of an antenna.

BACKGROUND

Radio communication devices often utilize an external antenna for receiving and transmitting communication signals. In the public safety environment, such as law enforcement, undercover operations often necessitate the concealment of an agent's radio communication device and its peripheral attachments. The length of the external antenna can be substantial enough to make it difficult to conceal as well as interfere with movement. Past antenna concealment assemblies have been fraught with complex components, cumbersome arrangements, and stiff form factors making them difficult and time consuming for users to set up and remove. Changes in regulatory allowed human absorption levels also need to be considered when seeking to conceal an antenna near the body.

Accordingly, it would be desirable to provide an antenna mounting apparatus that addresses the aforementioned issues.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
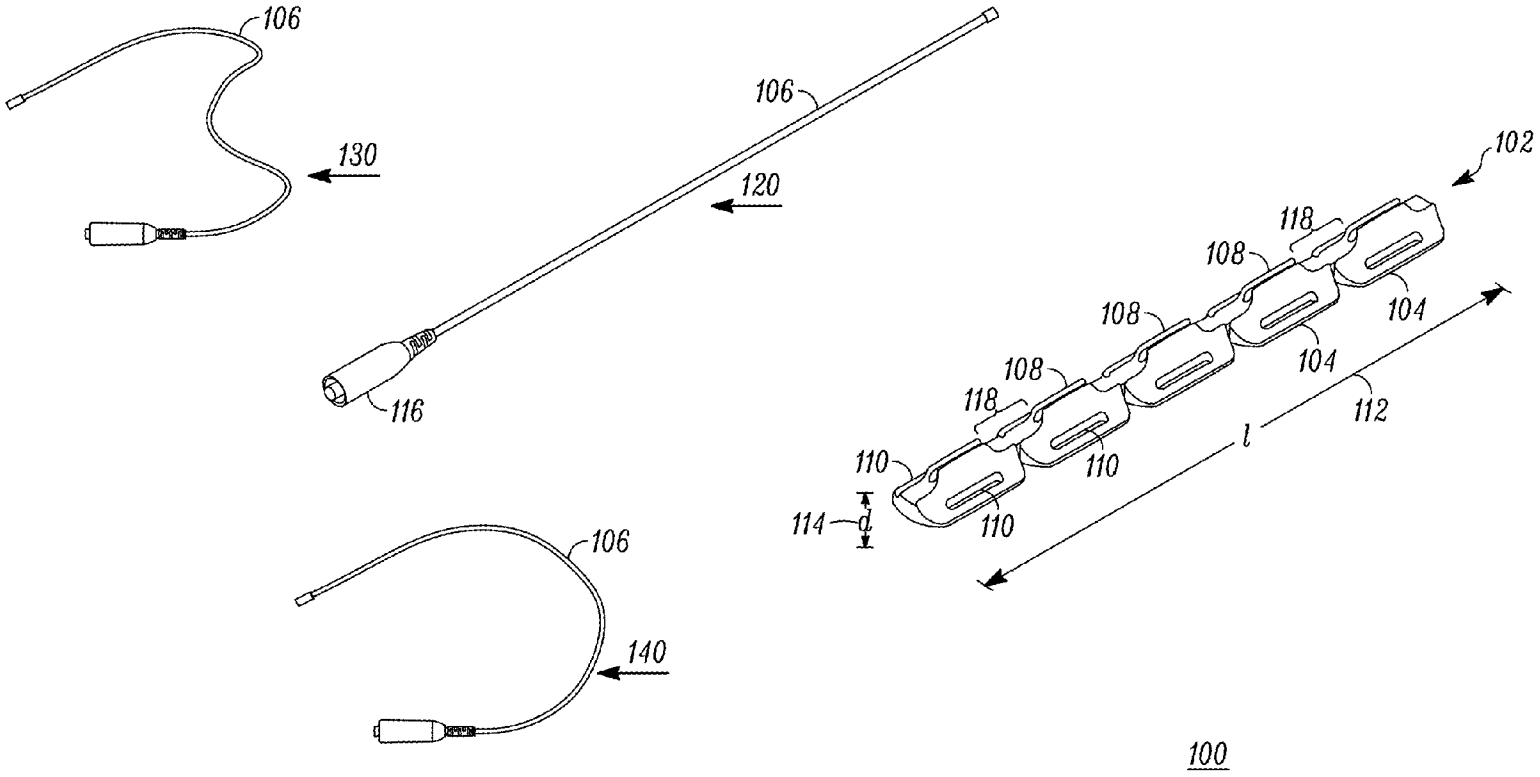
FIG. 1 shows a mounting apparatus for an antenna in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of the embodiments of shown.

The apparatus and method components have been represented where appropriate by conventional symbols in the drawings, showing only those specific details that are pertinent to understanding the embodiments shown so as not to obscure the disclosure with details that will be readily apparent to those of ordinary skill in the art having the benefit of the description herein. Other elements, such as those known to one of skill in the art, may thus be present.

DETAILED DESCRIPTION

Before describing in detail embodiments of the invention, it should be observed that such embodiments reside primarily in combinations of apparatus components related to a mounting apparatus for an antenna. Briefly, the mounting apparatus comprises a plurality of flexible interconnected spacer segments for receiving the antenna, the plurality of flexible interconnected spacer segments provide a continuous offset between the antenna and another surface. Each of the plurality of flexible interconnected spacer segments comprises a unitarily molded flexible link, each link having a triangular cross sectional geometry having an opening on top for receiving the antenna, and the top leading to a wider base for mounting to a surface. The links are separable providing for a customizable length and form factor.

FIG. 1 shows an antenna system 100 comprising a mounting apparatus 102 and antenna 106 formed in accordance with some embodiments of the invention. In accordance with some embodiments, the mounting apparatus 102 comprises a plurality of flexible interconnected spacer segments 104 for receiving the antenna 106. In accordance with some embodiments, the mounting apparatus 102 provides a continuous offset 114 between the antenna 106 and another surface. The offset 114 is illustrated by separation (d). The plurality of flexible interconnected spacer segments 104 provide the mounting apparatus 102 with a customizable length "l" 112 as will be further described later. In accordance with some embodiments, the mounting apparatus 102 is a unitarily molded piece part within which the plurality of flexible interconnected spacer segments 104 are separable for customizable length and form factor.

While the design of the antenna 106 is not the focus of this application, a brief description is provided for context. Antenna 106 is a flexible antenna formed of a flexible conductive wire covered in any non-electrically-conducting material, such as silicone rubber, pure rubber, flexible plastic, texin, santoprene to name a few. Various views of the flexibility of the antenna 106 are provided to show straight alignment 120, snake-like alignment 130, and curved alignment 140. The use of silicone rubber for the antenna 106 is advantageous because of its' soft properties thereby providing a flexible antenna that is inert to the human skin. The design of antenna 106 may be based on RF stimulated power and duration of RF exposure. The length of the antenna is determined by the electrical wavelength for each usage application, such as UHF, VHF, and 700/800 MHz, to name a few. For example, a flexible antenna having an electrical length of 1.2λ, may be used for 700/800 MHz applications and UHF applications. The flexible antenna may have for example, an electrical length of 0.25λ, for VHF applications. For the purposes of this application, the overall structure of the structure for antenna 106 does not significantly differ in dimensions and shape, except for the length. The length of the antenna 106 will vary depending on the operational frequency and power of the radio communication device; however the antenna radius and offset 114 "d" tends to remain constant across all bands. For example, the diameter for each of these antennas may be approximately 3.5 mm. Antenna 106 further comprises a connector 116, or other coupling means, for coupling the antenna to a communication device.

The antenna 106 is retained within the spacer segments by the plurality of integrally molded retention features 108 as part of the mounting apparatus 102. Insertion of antenna 106 into the mounting apparatus 102 is accomplished by inserting the antenna into a top opening of each of the plurality of flexible spacer segments 104 via a single finger press, advantageously providing a snap-in approach to antenna insertion. The opening of each integrally molded retention feature 108 conforms to the radius of the antenna 106, such that the antenna is retained by frictional resistance. A gap 118 is formed lengthwise between the integrated molded retention features 108. Each gap 118 provides a trough area between links within which the flexible antenna 106 can flex and bend as the mounting apparatus 102 is moved and bent. Removal of antenna 106 is accomplished by pulling the antenna away from the mounting apparatus.

In accordance with some embodiments, the plurality of interconnected spacer segments 104 form a linked configuration of multiple segments in a single unitary structure, wherein the links are capable of being separated. The plurality of flexible interconnected spacer segments 104 may each further comprise first and second slots 110. The first and second slots 110 can be used to accommodate straps or other attachment means, to be described later, for attaching the mounting apparatus to another surface, such as a user's body. Alternatively, or in addition to the straps, tape can be used to attach the mounting apparatus to another surface.

Figure 2:
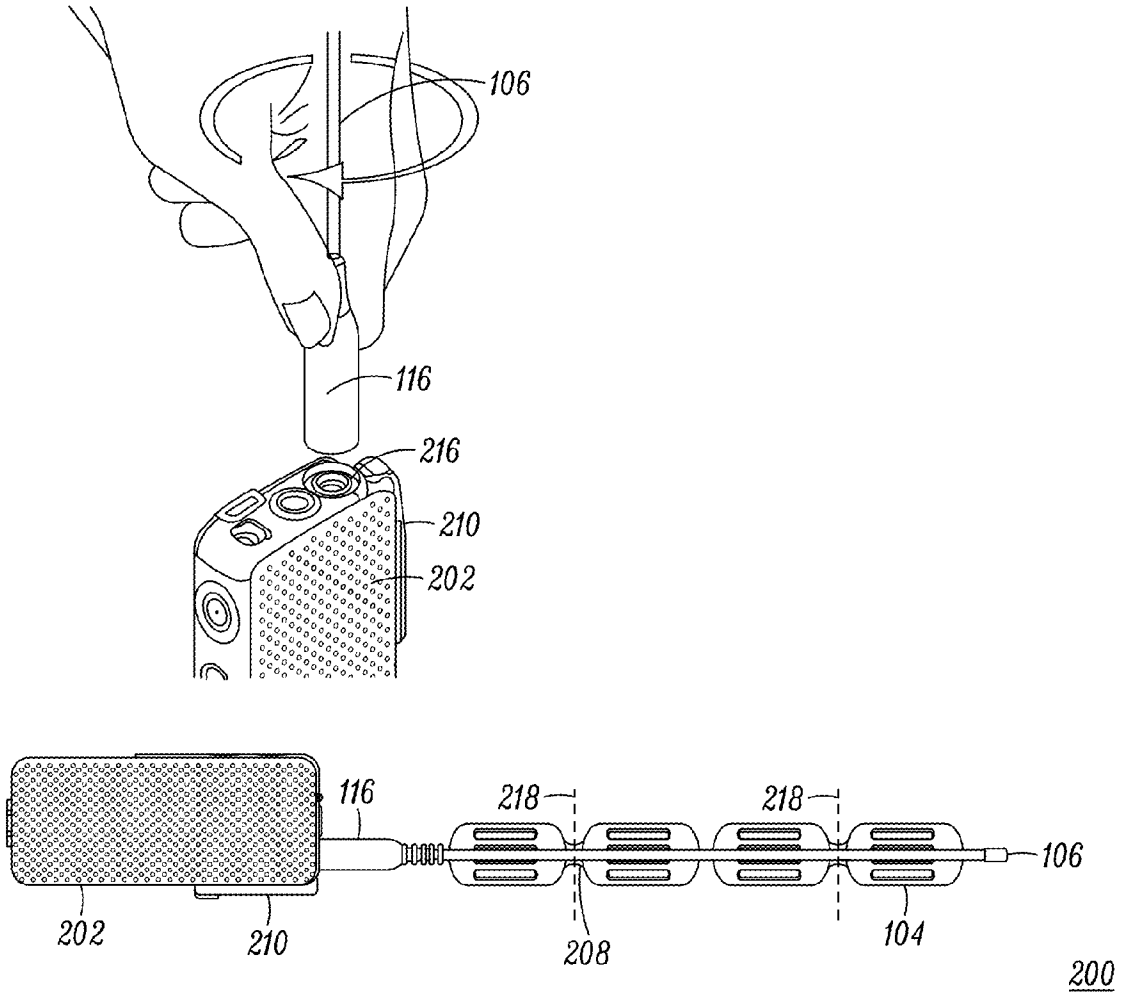
FIG. 2 shows the mounting apparatus and antenna coupled to a communication device in accordance with some embodiments of the invention.

FIG. 2 shows a communication system 200 comprising the mounting apparatus 102 with antenna 106 coupled therein and further being coupled to a radio communication device 202. Connector 116 of antenna 106 may be coupled to a corresponding radio connector 216 on the radio communication device 202, by insertion and rotation or other connecting interface means.

The radio communication device 202 contains, among other components, a processor, a transceiver, and I/O devices. The antenna 106 provides wireless transmission and reception for radio communication device 202. For example, the antenna may provide single band or multiband transmission and reception for UHF, VHF, and/or 700/800 MHz, to name a few.

In accordance with some embodiments, the plurality of flexible interconnected spacer segments 104 of the mounting apparatus 102 are separable 218 at joint 208 between each spacer segment and can thus accommodate antennas of different lengths as well as provide additional points of flexibility. The predetermined offset 114 (shown as "d" in FIG. 1) is set to ensure adequate distance to meet regulatory compliance. For example, the offset "d" may be set for 15 mm for radios operating at predetermined power levels for example, up to 5 Watts in the VHF, UHF, and 700/800 MHz bands to meet regulatory compliance. Being able to use a consistent offset allows the mounting apparatus to accommodate many different frequency bands or combinations of bands by simply adjusting the length by separating a segment or grouping of segments at joint 208 of the mounting apparatus.

The following Table provides examples of the number of spacer segments 104 for different antenna bands in accordance with some embodiments.

TABLE 1

Number of spacer segments for different antenna bands.

| Antenna Frequency Band | Number of spacers provided* | Number of segments |
|---|---|---|
| 700/800 MHz | 1 | 5 |
| UHF | 3 | 12 |
| VHF | 2 | 7 |

*One spacer comes with five segments.

Figure 3:
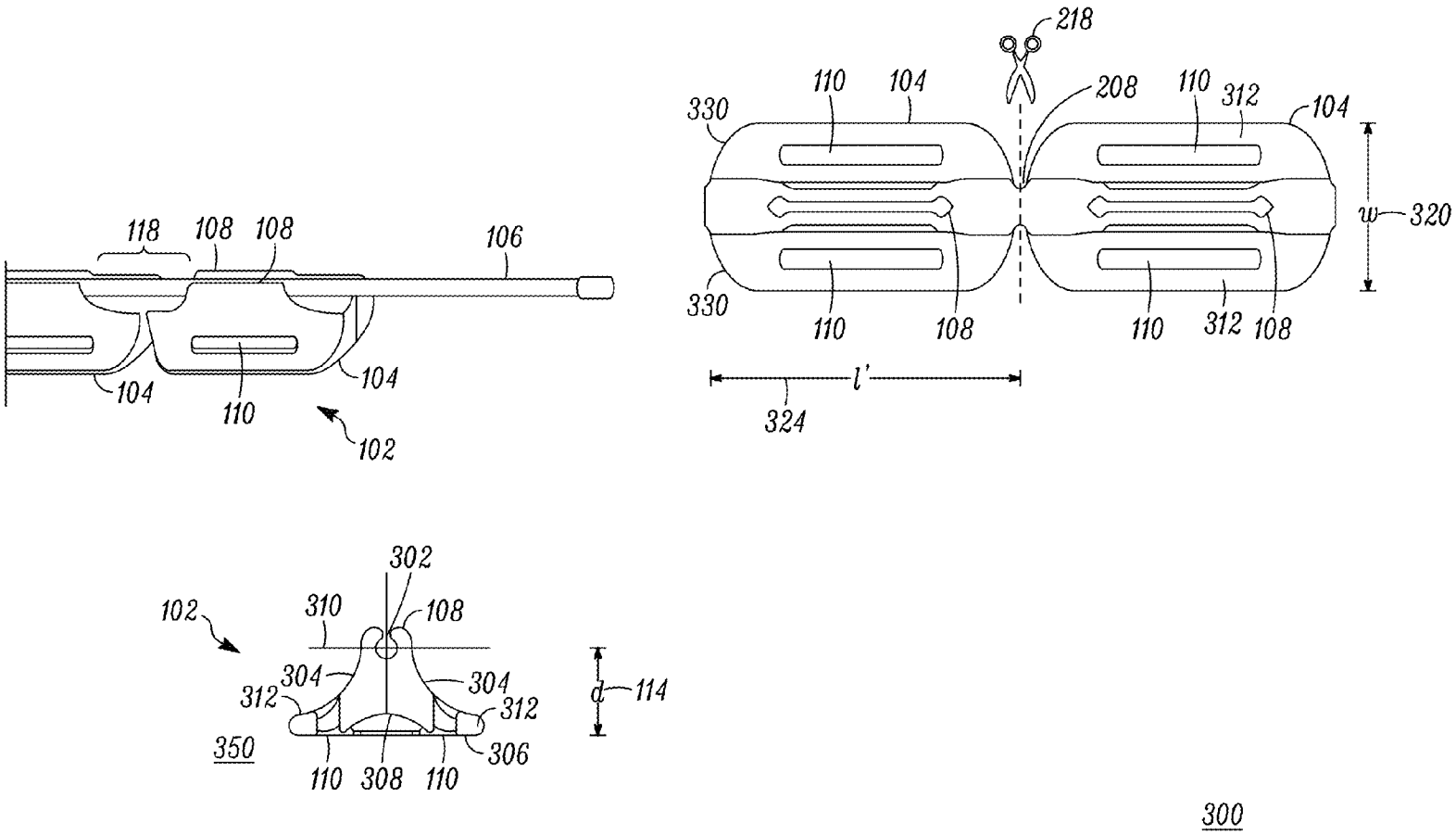
FIG. 3 shows various partial views of the mounting apparatus in accordance with some embodiments of the invention.

FIG. 3 shows various partial views 300 of the mounting apparatus 102 in accordance with some embodiments of the invention. Each flexible spacer segment 104 provides compressibility and twistability along with an appropriate rigidness for retaining the antenna 106, through the combination of shape and material.

In accordance with some embodiments, the shape of each flexible spacer segment 104 comprises a triangular cross-sectional geometry 350 which minimizes the visual volume impact exterior of clothing, particularly beneficial for covert applications. Covert applications involve a user wearing the mounting apparatus and antenna in a manner that cannot be seen. The triangular cross-sectional geometry 350 is preferably tapered to provide strength when using compressible materials.

Each of the flexible interconnected spacer segments 104 is molded as part of the overall unitarily molded mounting apparatus 102. Each spacer segment 104 comprises a top opening 302 provided by the integrally molded retention feature 108. The integrally molded retention feature 108 is formed of first and second rounded opposed lips joined by a radial interior surface having the top opening 302 for receiving and retaining the antenna 106.

The integrally molded retention feature 108 tapers downward along first and second sidewalls 304 forming flanges 312 at a bottom base surface 306. Each flange 312 has rounded corners 330 leading to the joint 208 thereby allowing for a thinner joint to be used. The thinner joint 208 provides for improved flexibility.

The wider bottom base surface 306 of the triangular cross-sectional geometry 350 prevents roll-over.

The mounting apparatus 102 may further comprise the first and second slots 110 located along the flanges 312 of tapered sidewalls 304 and wider bottom base surface 306. The wider bottom base surface 306 further comprises a contoured radius 308 formed therein and aligned beneath the integrally molded retention feature 108.

The gaps 118 formed lengthwise between segments 104 above the joints 208 provide a series of troughs within which the antenna 106 can flex in response to the mounting apparatus being bent or twisted. The form factor provided by the embodiments of the mounting apparatus 102 provides comfort for planar and/or contoured surface applications.

The dimensions for the mounting apparatus 102 can be adjusted for antennas of various lengths operating in single band or multi-band antenna frequencies in the public safety frequency domain. The customizable length "l" 112 and form fit can be adjusted by separation of segments at one or more joints 208, such as by cutting 218. Alternatively, a perforated feature along joint 208 which can be torn. Thus, various integrally molded interconnection form factors can be used between the links as part of the mounting apparatus 102. The ability to use different groupings of links facilitates another aspect of flexibility to the mounting apparatus 102. Different groupings of links will be shown and described in conjunction with FIG. 6.

An example of dimensions for a 700/800 MHZ antenna comprises a mounting apparatus 102 having an offset 114 "d" of approximately 15.6 millimeters for a spacer segment having a single segment length 324 of approximately 53.6 millimeters and a segment width 320 "w" of approximately 28 millimeters which provides an effective mounting apparatus using five interconnected links having an overall length 112 "l" of 266.0 millimeters. Thus, the geometry of the flexible spacer segments 104 lend themselves to a lower profile design when placed under clothing as opposed traditional devices.

The mounting apparatus 102 for UHF would be the longest with two groupings (of five links each) with an overall length of 532 mm. This can be accomplished using two 266 mm sections which equals 532 mm; however, the two groupings need not be line-to-line, as a spacing can be used between the groupings. The spacing allows additional flexibility but also greater separation offset "d" maintenance along the entire antenna wire length. The mounting apparatus 102 for VHF could be a single grouping of five spacers of 266 mm. The 700/800 MHz single grouping of five spacers could also be 266 mm in total length. The number of groupings can be flexible, for example: VHF-700/800 MHz multi-band can be achieved with one-grouping, and Low-band-UHF can be achieved with two groupings, Low-band being the 88-100 MHz band. The ability to use different groupings of links for different bands allows the overall form factor of amounting apparatus 102 to be used for different bands while adjusting the configuration to the length of the antenna.

Turning to the material selection, the mounting apparatus 102 may be formed of any non-electrically-conducting material, such as silicone rubber, pure rubber, flexible plastic, texin, or santoprene to name a few. The use of silicone rubber for the mounting apparatus 102 is particularly advantageous because of its' soft properties thereby providing a flexible mounting apparatus that is inert to the human skin. The material selection of silicone rubber provides several advantages in that the absence of organic material provides for a hypo-allergenic device which allows the mounting apparatus 102 to be worn directly against the skin without skin reactions that might occur with say, a latex based product.

The compressibility of the mounting apparatus material allows for the integrally molded top retention feature 108 to be formed having a circumferential radii opening 302 for receiving the antenna 106, conforming to the antenna, and retaining the antenna. The frictional resistance of the integrally molded retention feature 108 provides a sufficient rigidity to retain the antenna 106 as well as to permit removal of antenna.

The compressible and malleable material and form factor of mounting apparatus 102 also negates the need for any padding between the mounting apparatus and the user's skin or clothing or between clothing.

The flexible linked form factor of the mounting apparatus 102 preserves flexibility both in bending and twisting while providing a continuous offset from the body. The form factor of mounting apparatus 102 allows the antenna 106 to "glide" through the attachment points. Hence, the antenna can be adjusted during usage if a snag or tightness occurs as a result of unexpected excessive bending while being worn. The offset 114 is pre-determined and incorporated into the technology to maximize the ability to conform to various mounting positions, including those having tight radii.

Figure 4:
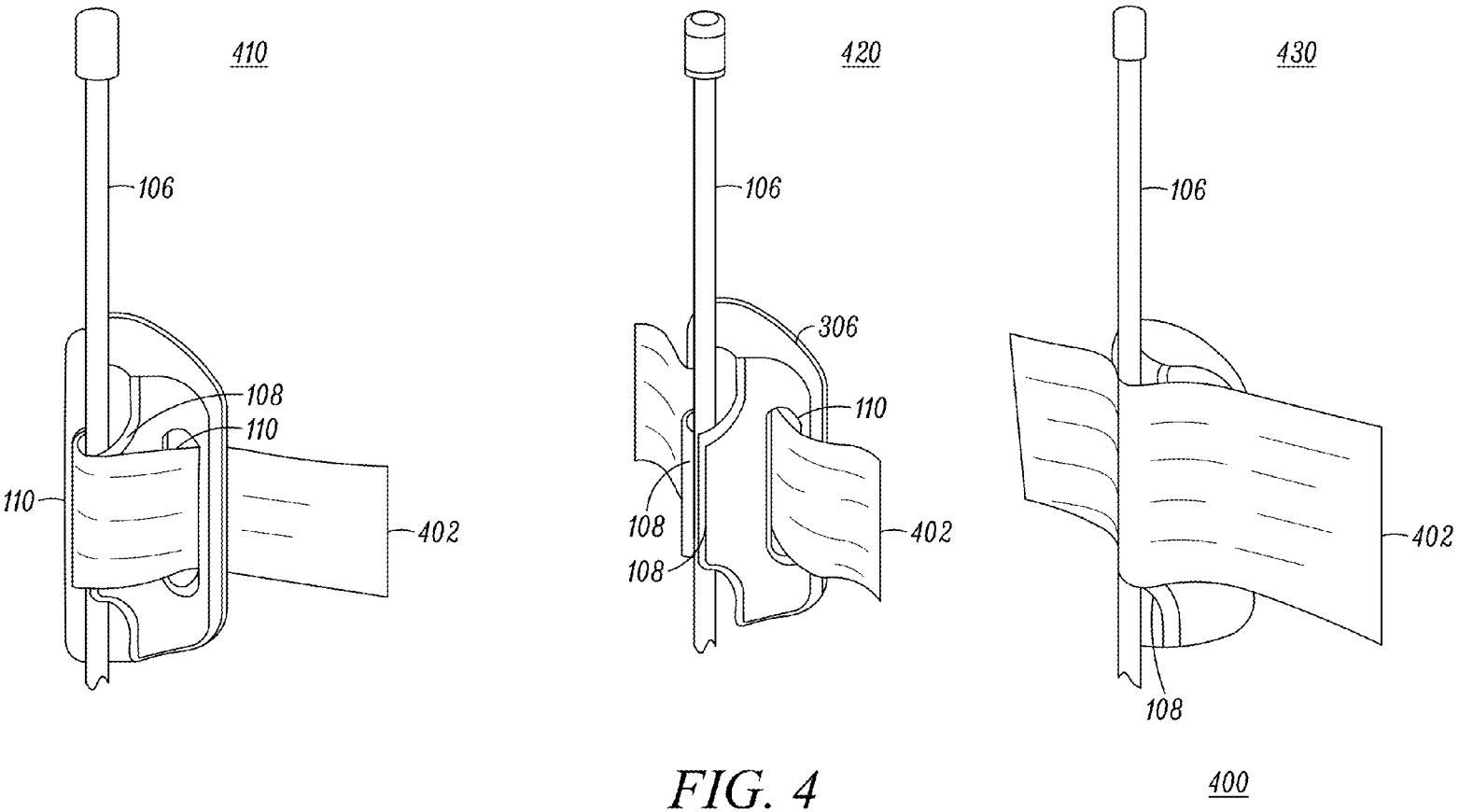
FIG. 4 shows three attachment options for the mounting apparatus in accordance with some embodiments of the invention.

FIG. 4 shows three attachment options 400 for the mounting apparatus 102 in accordance with some embodiments of the invention. The mounting apparatus 102 need not be attached to a surface at each individual segment. Attachment can be made using only a few locations over the same length, facilitating assembly and convenience for the user. Option 410 shows a strap or tape 402 applied over the integrally molded retention feature 108 and inserted through the first and second slots 110. Option 420 shows the strap or tape 402 inserted through the first and second slots 110, underneath the base 306. Option 430 shows the strap or tape 402 applied over the integrally molded retention feature 108, without insertion through the slots 110.

A combination of over and under tape and/or straps can be used if desired. The straps may be made from a variety of readily available non-electrically-conducting materials such as nylon, rubber, or other fabrics or materials. If tape is used, the tape may be medical tape for sticking to the skin or other type, depending on the application. The ability to route straps or tape 402 over the integrally molded retention feature 108 via the integrated slots 110, allows additional secured attachment. The ability to route straps or tape 402 beneath the antenna 106 through the slot of base 306 allows for quick assembly and disassembly without the use of loop or hook materials.

The use of tape 402 for securing the mounting apparatus without the use of slots 110 allows for quick application of the mounting apparatus 102 to a surface. If it is known that the mounting apparatus 102 will always be used with tape, then the slots 110 can be eliminated from the structural design if desired. Additionally, adhesive tape could run lengthwise (along length 112 of FIG. 1) along the outer flanges 312 if desired.

In all of the embodiments of FIG. 4, the antenna 106 is held by friction between the material of the integrally molded retention feature 108 and antenna 106. When using tape 402 to couple the mounting apparatus 102 to a surface, the tape may be placed over the integrally molded retention feature 108 without touching the antenna 106 thereby allowing the antenna to continue to slide along the spacer. The ability to slide the antenna 106 through the segments of mounting apparatus 102 can be adjusted based on how tightly the tape secures or clamps the segment to a surface. For some applications, the strap or tape 402 can be in contact with the antenna 106 while still providing sufficient flexibility through the gaps 118 and space between groupings (shown later). Different user applications can thus be accommodated based on where the mounting apparatus is placed on the body. In other words, some areas it may be preferable to mount more tightly and securely than others to help maintain a combination of overall secure attachment and movement.

Accordingly, the mounting apparatus 102 having the plurality of flexible interconnected spacer segments 104 can be attached to a surface in many different ways making it highly customizable for each usage application. Different usage applications may comprise wearing the mounting apparatus directly on the skin, directly on a garment, in between skin and garment, in between garments, or a combination of any of these.

Figure 5:
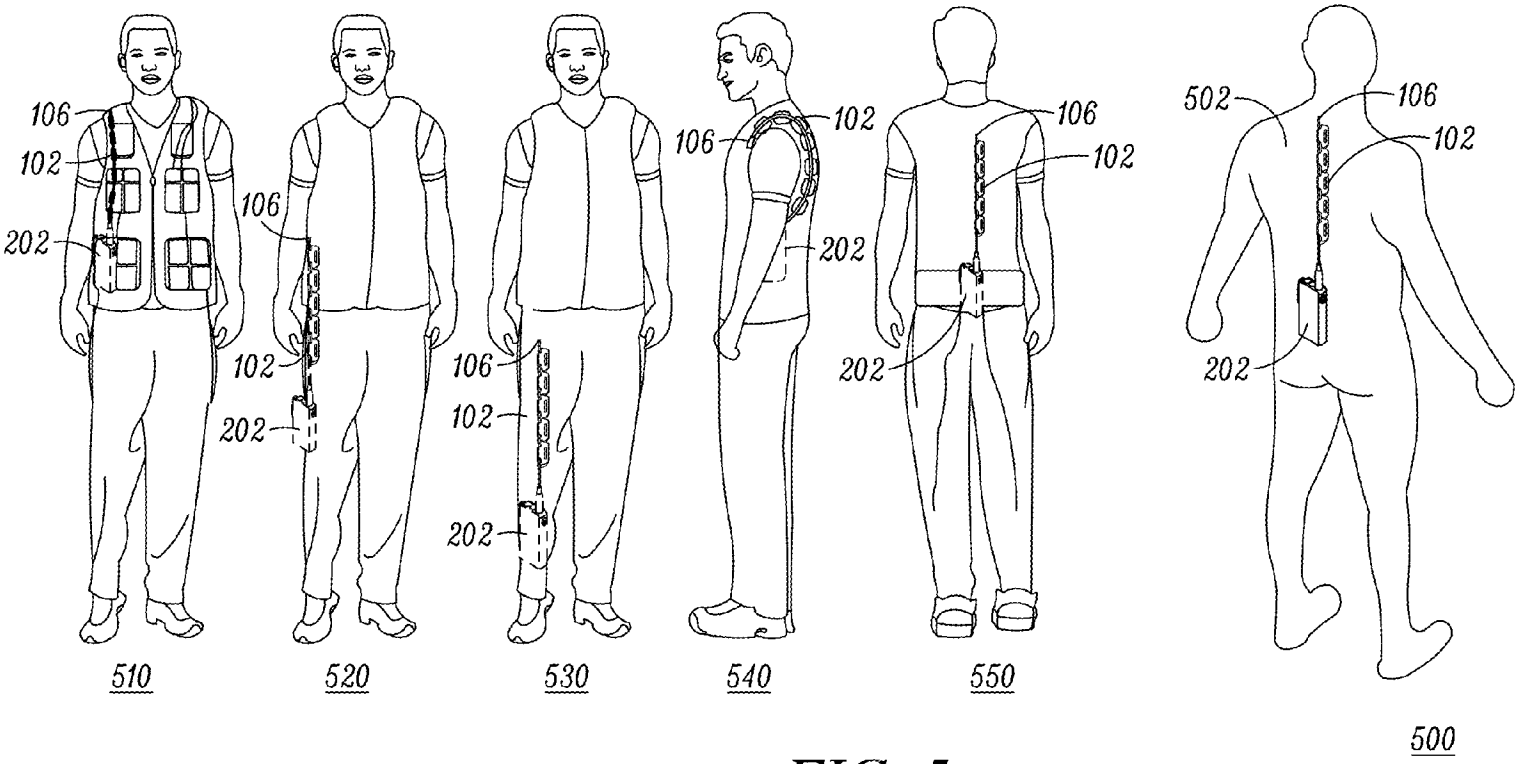
FIG. 5 shows some body worn examples for the antenna mounting apparatus in accordance with some embodiments of the invention.

FIG. 5 shows some body worn examples 500 for the antenna mounting apparatus 102 in accordance with some embodiments of the invention. Surface 502 may be a contoured or planar body surface, with or without a garment. The integrally molded retention features 108 conforms to and retains the antenna 106 while the contoured radius 308 (shown in FIG. 3) sits along the user's back. The mounting apparatus 102 may be strapped around the user or taped as previously described. The mounting apparatus may be worn directly against the user's skin or on a garment or in between garments. The offset "d" is selected to ensure regulatory compliance for absorption rates. The ability to customize the length of the mounting apparatus to the antenna is highly beneficial to the user. The flexibility and compressibility of the mounting apparatus and the contoured radius allow the user to bend and twist with comfort and ease.

The tapering of the triangular cross-sectional geometry 350 provides strength when using compressible materials. This contributes to comfort when attached immediately adjacent to the human body surface 502 while maintaining the attachment for the end user. The various views of 500 show examples of radio 202 with mounting apparatus 102 having antenna 106 inserted therein in different contouring configurations.

While optimum antenna performance is typically obtained in straight line configuration, there may be situations where a user needs to use other mounting configurations, for example depending on an undercover assignment. The ability to flex, twist, and bend the mounting apparatus 102 not only provides comfort to the user but further allows the mounting configurations to conform to a variety of contours.

Examples of various mounting configurations include but are not limited to examples or embodiments 510, 520, 530, 540, 550. Embodiment 510 shows radio 202 with mounting apparatus mounted between garments (within pockets). Embodiment 520 shows radio 202 on user's leg with mounting apparatus along user's thigh either on the pant leg or strapped to the skin. Embodiment 530 shows radio 202 in user's sock and mounting apparatus running along the user's leg. Embodiment 540 shows radio beneath user's armpit with mounting apparatus contouring over the shoulder blade. Embodiment 550 shows radio 202 coupled to a belt and mounting apparatus 102 running along the user's back (on skin or on shirt). Other configurations are also possible. The lengths shown in these examples are for illustration purposes only and could be varied depending on the length of the antenna 106. Different groupings of the mounting apparatus can also be used for flexibility. Thus, the mounting apparatus 102 provided by the embodiments can be attached to on or under clothing or directly on the skin with customizable length and form fit.

The mounting apparatus maximizes the ability to conform to various mounting positions, including those having tight radii. Past devices required securing each device individually, whereas the mounting apparatus 102 can be attached in only a few locations over the same length, facilitating assembly and convenience by the user. Thus, the mounting apparatus 102 provides the benefit of variable contoured form factors.

Figure 6:
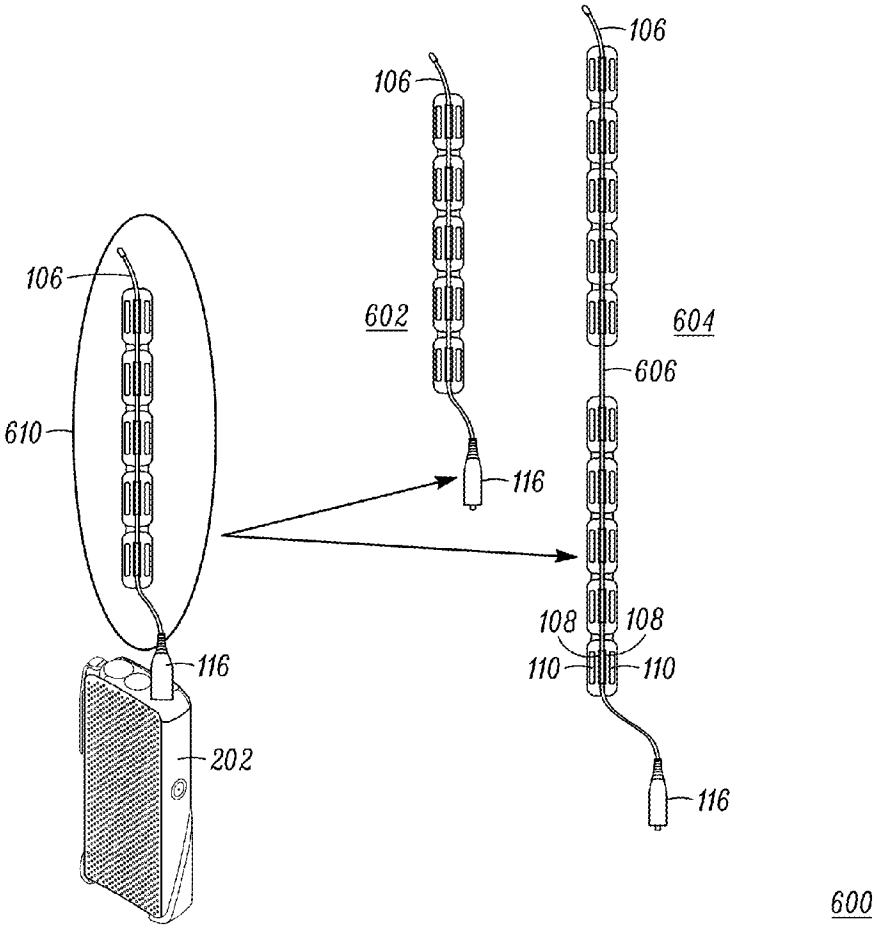
FIG. 6 shows various adjustable characteristics for the antenna mounting apparatus in accordance with some embodiments of the invention.

FIG. 6 shows various adjustable characteristics for the antenna mounting apparatus 102 in accordance with some embodiments of the invention. Examples of two form factors 602 and 604 are shown. In accordance with some embodiments, form factor 602 comprises a single grouping of the plurality of flexible spacer segments 104 coupled in series and retaining the antenna 106. Form factor 602 thus provides a linked configuration of multiple mounting segments in a single structure. Form factor 602 is shown coupled to radio 202 via connector 116 at 610. Form factor 604 can likewise be coupled at 610, in a similar manner.

In accordance with some embodiments, separate groupings of spacers can be used such as the groupings shown at 604. Here, the plurality of flexible interconnected spacer segments is formed as first and second groups separated by a space 606 and daisy changed via the antenna 106. This form factor provides further flexibility for applications requiring a longer antenna. Groupings can be used in short applications as well to provide increased flexibility to the overall structure while maintaining the offset. The number of groupings and spacing between groupings can be used to accommodate antennas of different lengths, while providing a variety of form factors, such as those examples shown in FIG. 5. The positioning of the segments 104 along the antenna 106 can be adjusted to maintain a predetermined separation from the body, for example a separation of 0.5 inches.

Figure 7:
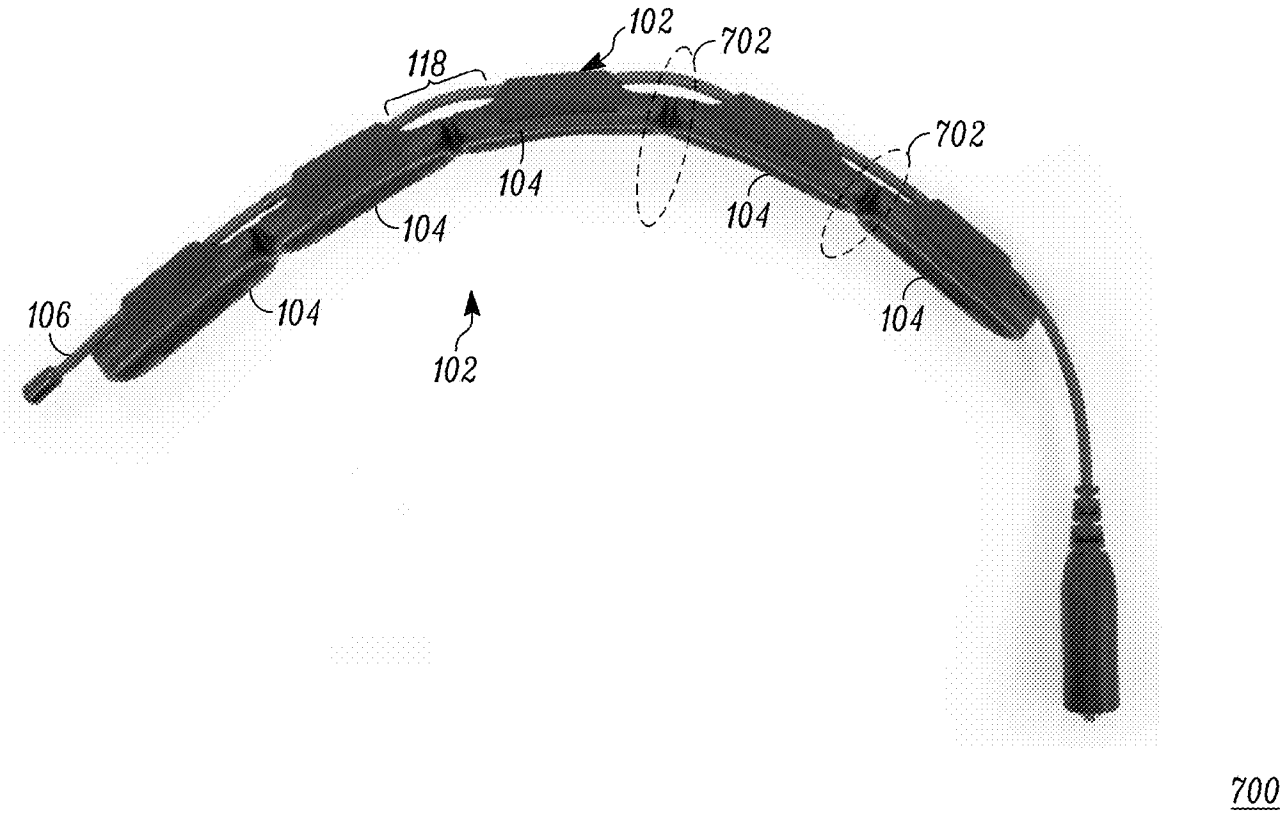
FIG. 7 is a scanned photograph showing an example of the flexibility of the mounting apparatus and antenna in accordance with some embodiments of the invention.

FIG. 7 is a scanned photograph 700 of an implementation showing an example of flexibility 702 provided by mounting apparatus 102 having antenna 106 inserted within the plurality of flexible interconnected spacer segments 104 in accordance with some embodiments of the invention. FIG. 7 shows how antenna 106 is able to flex, for example at 702, within and along the gaps 118.

Figure 8:
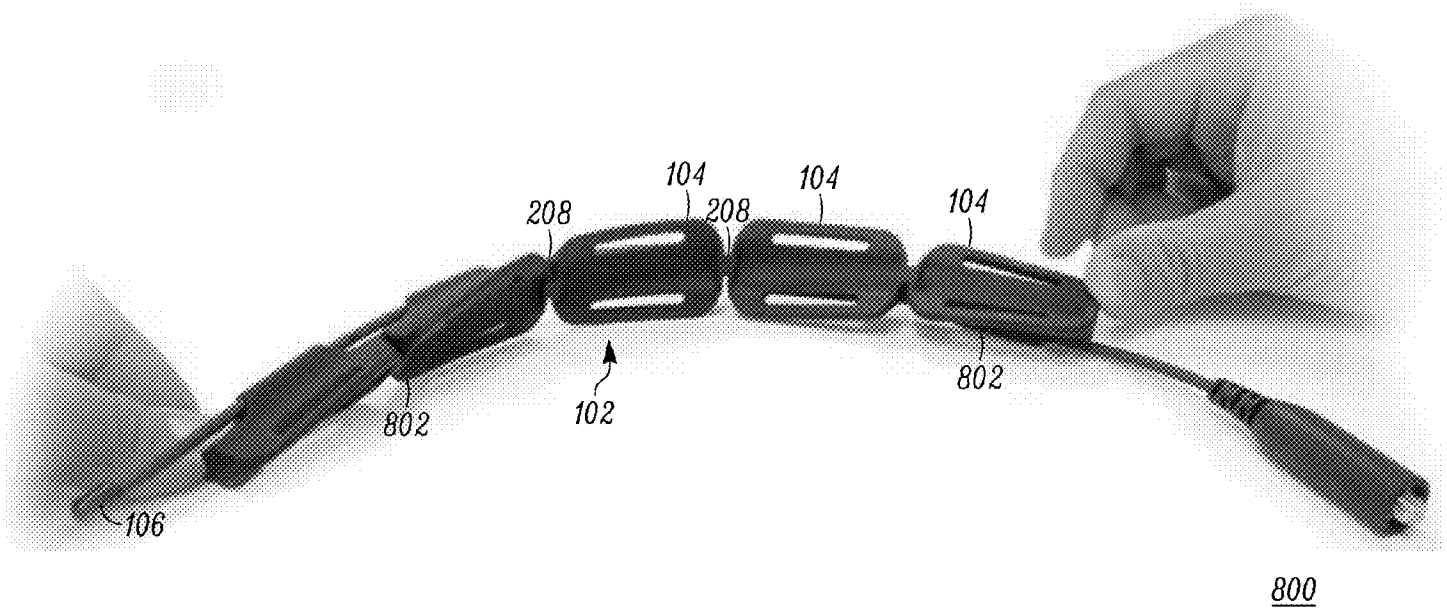
FIG. 8 is a scanned photograph showing an example of twistability of the mounting apparatus and antenna in accordance with some embodiments of the invention.

FIG. 8 is a scanned photograph 800 of an implementation of the mounting apparatus 102 and antenna 106 showing an example of twistability 802 of the apparatus in accordance with some embodiments. The twisting can occur between segments 104 at joints 208 as well as along the segment 104 itself.

Figure 9:
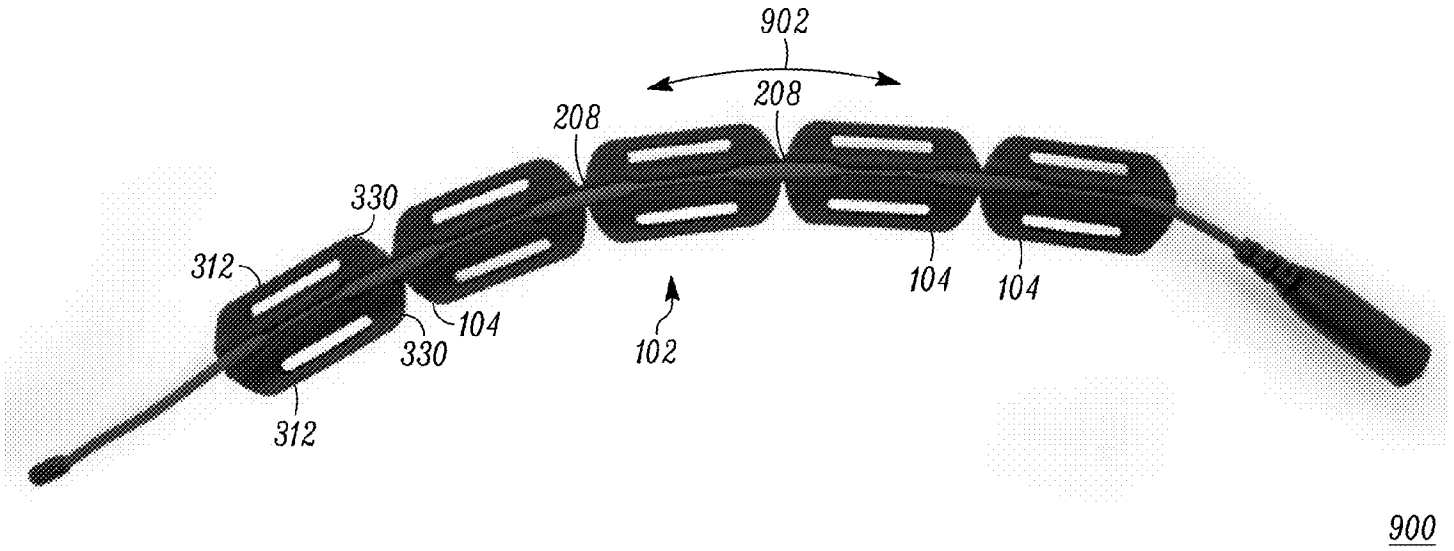
FIG. 9 is a scanned photograph showing an example of the body contouring capability provided by the apparatus in accordance with some embodiments.

FIG. 9 is a scanned photograph 900 of an implementation of the mounting apparatus 102 and antenna 106 showing an example of lateral flexibility 902 of the apparatus in accordance with some embodiments. The lateral flexibility 902 can occur between segments 104 at joints 208. The rounded corners 330 of each flange 312 lead to the joint 208 thereby allowing for a thinner joint to be used and more space for flexing. The use of a thin molded joint 208 facilitates lateral flexibility and bending of the mounting apparatus 102 while still retaining the antenna 106.

Figure 10:
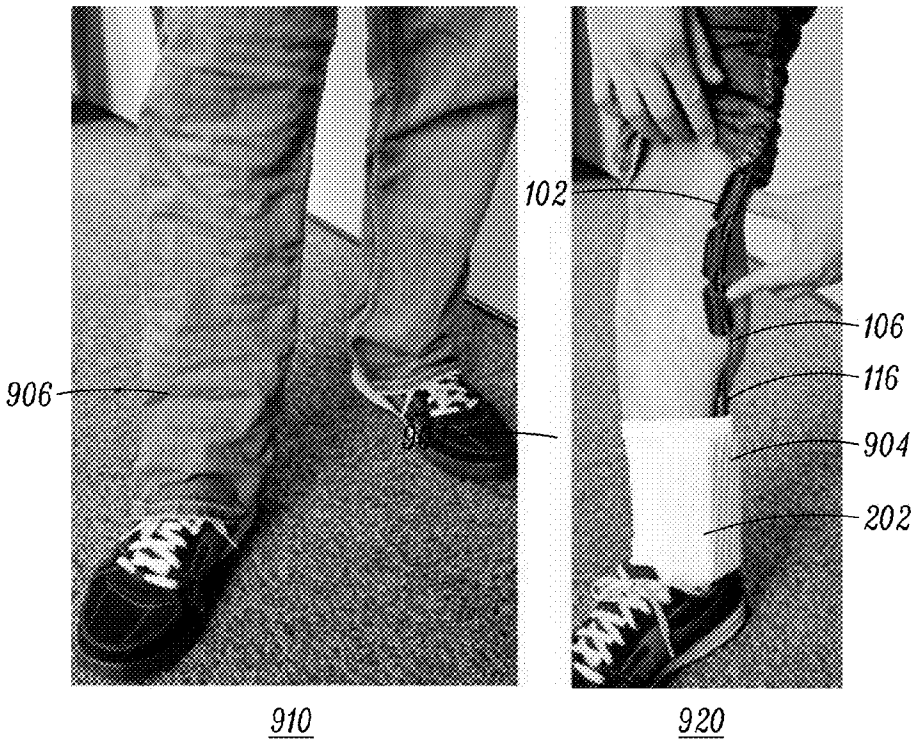
FIG. 10 shows a more detailed drawing of the mounting apparatus in accordance with some embodiments.

FIG. 10 is a scanned photograph 1000 of the mounting apparatus 102 and antenna 106 showing the body contouring capability and concealment of the apparatus in accordance with some embodiments. View 910 shows a garment, such as pant leg 906, concealing the mounting apparatus 102 and antenna 106. View 920 shows the pant leg 906 raised revealing a radio, such as radio 202, held within a user's sock 904 and the mounting apparatus 102 with antenna 106 inserted therein running along the user's leg.

Accordingly, the mounting apparatus 102 provides flexibility, bending capability and conformability to both planar surfaces and contoured surfaces.

Figure 11:
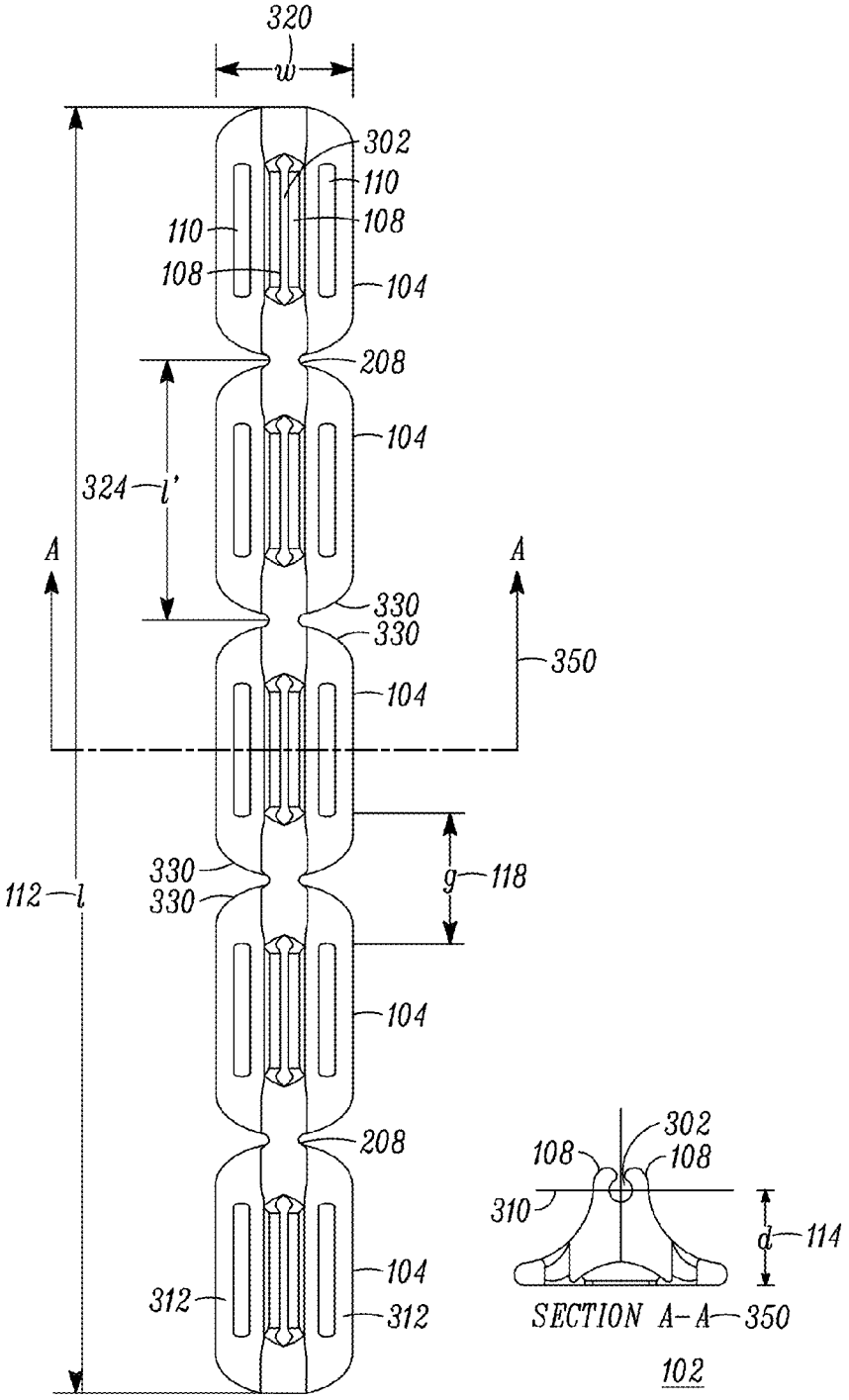
FIG. 11 shows a more detailed drawing of the mounting apparatus in accordance with some embodiments.

FIG. 11 shows a more detailed drawing of the mounting apparatus 102 in accordance with some embodiments. The triangular cross sectional geometry 350 (section A-A) shows the offset 114 "d" and the integrally molded retention features 108 forming opposing rounded lips having an opening 302 with internal radius surface 310. This geometry 350 maximizes the surface area for contouring and conforming to the antenna 106 (antenna shown in other figures). The flanges 312 have rounded corners 330, thereby eliminating any sharp edges. The rounded corners 330 of each flange 312 lead to the joint 208 thereby allowing for a thinner joint to be used. The use of a thin molded joint 208 facilitates lateral flexibility and bending of the mounting apparatus 102. Additionally, the thin molded joint 208 is easier to cut or tear along perforations for length adjustment.

The gap 118 between the retention features 108, further provides space within which the antenna can flex and move while still being held within retention features 108.

Accordingly, there has been provided a flexible mounting apparatus for mounting an antenna. The low profile nature of the retention features described in by some embodiments provides an improvement over traditional mounting devices. The mounting apparatus 102 described in accordance with some embodiments is far less restrictive that previously available products. The use of unitarily molded flexible configuration has eliminated the need for individual clips, screws, and other individual piece parts has been eliminated. The snap-in attachment via by using a finger press facilitates the insertion of the antenna into the mounting apparatus, and the gliding out or pulling of the antenna provides for easy removal.

While designed for concealment, the mounting apparatus 102 can also be worn external to clothing if desired thus being wearable both over and under garments, including directly to the human body. The ability to route straps or tape above the antenna 106 via the integrated slots, allows additional secured attachment. The ability to route straps beneath the antenna 106 allows for quick assembly and disassembly without the use of loop or hook materials. The use of straps or tape for securing the mounting apparatus allows multiple locations to be used for mounting the apparatus without the use of specialty garments. The flexible linked form factor of the mounting apparatus preserves flexibility both in bending and twisting while providing a continuous offset from the body. This offset is pre-determined and incorporated into the technology described by the mounting apparatus maximizes the ability to conform to various mounting positions.

While described in terms of bodily worn applications for humans, the embodiments for the mounting apparatus can also extend to animals, for example rescue dogs needing to wear GPS antennas as part of search and rescue operations. Further, other applications requiring the mounting of an antenna in variable contoured form factors could benefit from the described embodiments.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure and Summary section are provided to allow the reader to quickly ascertain the nature of the technical disclosure. It is submitted with the understanding that neither will be used to interpret or limit the scope or meaning of the claims. In addition, in the foregoing Detailed Description, it can be seen that various features are grouped together in some embodiments for the purpose of streamlining the disclosure. This method of disclosure is not to be interpreted as reflecting an intention that the embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

Those skilled in the art will recognize that a wide variety of modifications, alterations, and combinations can be made with respect to the above described embodiments without departing from the spirit and scope of the invention and that such modifications, alterations, and combinations are to be viewed as being within the scope of the inventive concept. Thus, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims issuing from this application. The invention is defined solely by any claims issuing from this application and all equivalents of those issued claims.

The invention claimed is:

1. A mounting apparatus for an antenna, comprising:

a plurality of flexible interconnected spacer segments for receiving the antenna, the plurality of flexible interconnected spacer segments for providing a continuous offset between the antenna and another surface, each of the flexible spacer segments comprising a triangular cross sectional geometry having a base and a retention feature for receiving the antenna at a top; and wherein each of the plurality of flexible interconnected spacer segments are separable at a perforated region between spacer segments to provide adjustable lengths to the mounting apparatus.

2. The mounting apparatus of claim 1, wherein the mounting apparatus comprising the plurality of flexible interconnected spacer segments is a unitarily molded piece part.

3. The mounting apparatus of claim 1, wherein the plurality of flexible interconnected spacer segments are separable at a perforated region to further provide a customizable form factor for the mounting apparatus.

4. The mounting apparatus of claim 1, wherein:

each of the plurality of flexible interconnected spacer segments are formed of a compressible and twistable material selected from one of a silicone rubber, a pure rubber, a flexible plastic, a texin, and a santoprene.

5. The mounting apparatus of claim 1, wherein the plurality of interconnected spacer segments form a linked configuration of multiple segments in a single structure.

6. The mounting apparatus of claim 1, wherein the antenna is slideable within the mounting apparatus.

7. The mounting apparatus of claim 1, wherein the antenna flexes within the mounting apparatus as the mounting apparatus is twisted or bent.

8. The mounting apparatus of claim 1, wherein the plurality of flexible interconnected spacer segments each comprise first and second slots formed within the triangular cross sectional geometry.

9. The mounting apparatus of claim 8, wherein the first and second slots of each spacer provide three attachment options for attaching the mounting apparatus to the surface, the three attachment options comprising:

a first option in which a strap or tape is coupled over the antenna through the first and second slots; and a second option in which a strap or tape is coupled through the first and second slots underneath each spacer; and a third option in which a strap or tape is coupled over the antenna and over the slots.

10. The mounting apparatus of claim 1, wherein the plurality of flexible interconnected spacers provide mounting for both planar and body contouring mounting.

11. The mounting apparatus of claim 1, wherein the surface comprises a user's skin.

12. The mounting apparatus of claim 1, wherein the surface comprises clothing.

13. The mounting apparatus of claim 1, wherein the continuous offset is a pre-determined offset.

14. The mounting apparatus of claim 1, wherein the continuous offset of the antenna is substantially 15 mm.

15. The mounting apparatus of claim 1, wherein the continuous offset is determined to accommodate an antenna which is operable at predetermined power levels in VHF, UHF, and 700/800 MHz bands.

16. The mounting apparatus of claim 1, wherein the plurality of flexible interconnected spacers are mountable to the surface without having to individually mount each spacer to the surface.

17. The mounting apparatus of claim 1, wherein the spacers are mounted to the surface utilizing less than an entire plurality of the plurality of flexible interconnected spacers.

18. The mounting apparatus of claim 1, wherein the plurality of flexible interconnected spacer segments are formed as first and second groups separated by a space, the antenna mounting within the first and second groups across the space.

19. The mounting apparatus of claim 1, wherein the mounting apparatus provides variable contoured form factors.

20. The mounting apparatus of claim 1, wherein the plurality of flexible interconnected spacer segments are each formed of a silicone rubber material.

21. A mounting apparatus for an antenna, comprising:

a plurality of flexible interconnected spacer segments for receiving the antenna, the plurality of flexible interconnected spacer segments for providing a continuous offset between the antenna and another surface, each of the flexible spacer segments comprising:

a triangular cross sectional geometry having:

first and second side surfaces;

a base having a contoured radius; and a top retention feature for receiving and conforming to the antenna;

a gap being provided between each of the retention features of the plurality of spacer segments, the gap providing an area for the antenna to flex in response to the mounting apparatus being bent or twisted.

22. The mounting apparatus of claim 21, wherein the top retention feature is formed as part of an integrally molded retention feature at each of the plurality of spacer segments within which to mount the antenna via a single finger press.

23. A mounting apparatus for an antenna, comprising:

a plurality of flexible interconnected spacer segments for receiving the antenna, the plurality of flexible interconnected spacer segments for providing a continuous offset between the antenna and another surface, each of the flexible spacer segments comprising a triangular cross sectional geometry having a base and a retention feature for receiving the antenna at a top; and wherein the base of each of the flexible spacer segments has a contoured radius for mounting against a surface.

24. A mounting apparatus for an antenna, comprising:

a plurality of flexible interconnected spacer segments for receiving the antenna, the plurality of flexible interconnected spacer segments for providing a continuous offset between the antenna and another surface, each of the flexible spacer segments comprising a triangular cross sectional geometry having a base and a retention feature for receiving the antenna at a top; and wherein the triangular cross sectional geometry is tapered.

* * * * *